US010575657B2

(12) United States Patent
Acevedo et al.

(10) Patent No.: US 10,575,657 B2
(45) Date of Patent: Mar. 3, 2020

(54) CONVERTIBLE AUTO-ROCKING ROCKER

(71) Applicant: Mattel, Inc., El Segundo, CA (US)

(72) Inventors: Santiago Acevedo, Buffalo, NY (US); Ross Rumfola, III, Akron, NY (US); Jon Podeszek, Hamburg, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 16/001,241

(22) Filed: Jun. 6, 2018

(65) Prior Publication Data

US 2019/0374044 A1 Dec. 12, 2019

(51) Int. Cl.

| | |
|---|---|
| ***A47D 13/10*** | (2006.01) |
| ***A47C 3/02*** | (2006.01) |
| ***A47D 11/00*** | (2006.01) |
| ***A47D 9/02*** | (2006.01) |

(52) U.S. Cl.

CPC ..... *A47D 11/005* (2013.01); *A47D 9/02* (2013.01); *A47D 13/102* (2013.01)

(58) Field of Classification Search

CPC ..... A47D 11/005; A47D 9/02; A47D 13/102
USPC ..... 297/118, 271.6, 274, 260.1, 260.2, 272.1
See application file for complete search history.

(56) References Cited

U.S. PATENT DOCUMENTS

| | | | | |
|---|---|---|---|---|
| 1,812,699 | A | 6/1931 | Hursh | |
| 3,004,793 | A | 10/1961 | Loomis | |
| 3,359,035 | A | 12/1967 | Schiffman | |
| 4,019,751 | A | 4/1977 | Nakao | |
| 5,178,438 | A * | 1/1993 | Beger | A47D 13/105 297/271.6 |
| 5,187,826 | A | 2/1993 | Mariol | |
| 5,382,072 | A * | 1/1995 | Diefenbach | A47D 1/04 297/271.6 X |
| 6,174,028 | B1 | 1/2001 | Yang et al. | |
| 6,540,292 | B2 * | 4/2003 | Darling | A47D 13/102 297/271.6 X |
| D478,220 | S | 8/2003 | Chang | |
| 6,682,137 | B2 | 1/2004 | Hsia | |
| 6,733,071 | B2 | 5/2004 | Guillot et al. | |
| 6,811,217 | B2 * | 11/2004 | Kane | A47D 13/102 297/271.6 X |
| 7,255,393 | B2 * | 8/2007 | Flanagan | A47D 13/10 297/274 X |
| 7,506,922 | B2 * | 3/2009 | Schulte | A47C 3/03 297/271.6 X |
| 7,878,915 | B2 * | 2/2011 | Myers | A47D 13/105 472/118 |
| 8,205,943 | B2 * | 6/2012 | Zhong | A47D 13/102 297/271.6 X |
| D689,703 | S | 9/2013 | Oren et al. | |
| 8,746,794 | B2 | 6/2014 | Oren et al. | |
| 8,770,660 | B2 | 7/2014 | Chen et al. | |
| 8,845,023 | B2 | 9/2014 | Chen et al. | |

(Continued)

*Primary Examiner* — Rodney B White

(74) *Attorney, Agent, or Firm* — Edell, Shapiro & Finnan, LLC

(57) ABSTRACT

An auto-rocking rocker that converts from an infant sleeper to a toddler seat. The convertible rocker comprises a support section that has a concave portion for receiving a child, a frame assembly coupled to the support section, and an auto-rocking mechanism coupled to the frame assembly. The auto-rocking mechanism is configured to be operable while the convertible rocker is in the infant sleeper configuration and inoperable while the convertible rocker is in the toddler seat configuration.

20 Claims, 6 Drawing Sheets

(56) References Cited

U.S. PATENT DOCUMENTS

| | | | | |
|---|---|---|---|---|
| 8,845,028 | B2 * | 9/2014 | Miller | A47D 1/002 297/118 |
| D737,063 | S | 8/2015 | Lin et al. | |
| 2002/0063457 | A1 * | 5/2002 | Hsia | A47D 13/102 297/271.6 |
| 2007/0040430 | A1 * | 2/2007 | Flannery | A47D 1/08 297/271.6 |
| 2007/0063558 | A1 * | 3/2007 | Stewart | A47C 3/029 297/260.2 |
| 2007/0257534 | A1 * | 11/2007 | Schulte | A47C 3/03 297/271.6 |
| 2009/0284050 | A1 | 11/2009 | Myers | |
| 2010/0001566 | A1 | 1/2010 | Yehuda | |
| 2011/0260507 | A1 | 10/2011 | Parness et al. | |
| 2012/0274105 | A1 * | 11/2012 | Chen | A47D 1/08 297/271.6 X |
| 2015/0015036 | A1 | 1/2015 | Soriano | |
| 2015/0082539 | A1 | 3/2015 | Lin et al. | |
| 2015/0289677 | A1 | 10/2015 | Huntsberger et al. | |
| 2015/0342367 | A1 | 12/2015 | Corso et al. | |
| 2015/0342368 | A1 * | 12/2015 | Corso | A47D 13/102 297/271.5 |
| 2016/0058201 | A1 | 3/2016 | Pavkov et al. | |
| 2016/0066708 | A1 * | 3/2016 | Sclare | A47D 13/105 297/260.2 |
| 2016/0157633 | A1 | 6/2016 | Aboukrat et al. | |
| 2016/0227939 | A1 | 8/2016 | Tadipatri et al. | |
| 2016/0374481 | A1 | 12/2016 | Sclare et al. | |
| 2017/0251830 | A1 * | 9/2017 | Sclare | A47D 9/02 |
| 2017/0251831 | A1 * | 9/2017 | Perrin | A47D 13/102 |
| 2018/0098641 | A1 * | 4/2018 | Kapanzhi | A47D 1/02 |

* cited by examiner

CONVERTIBLE AUTO-ROCKING ROCKER

FIELD OF THE INVENTION

The present invention relates generally to infant and toddler support devices, and in particular, an auto-rocking rocker that converts from an infant sleeper to a toddler seat.

BACKGROUND OF THE INVENTION

Infant support devices such as sleepers and bassinets provide a safe, comfortable, and sanitary place for infants to rest. A rocker is a type of infant support device that is designed to rock back and forth and produce a rocking motion that soothes and pacifies a resting infant. Rockers with auto-rocking mechanisms have further been developed to eliminate the need for a parent to manually rock the rocker.

However, infants quickly become toddlers and outgrow conventional infant rockers in a short amount of time. Thus, there is a need for a rocker that can be modified to "grow" with the child and still be serviceable when the child is no longer an infant. There is also a need for rockers with auto-rocking mechanisms to be able to be modified in a way that provides for continued use after the child becomes too heavy for the auto-rocking mechanism.

SUMMARY OF THE INVENTION

The present invention provides an auto-rocking rocker that can convert between an infant sleeper and a toddler seat. Compared to conventional rockers, the ability to convert into different configurations suitable for both infants and toddlers gives the rocker an extended useable lifespan and consequently greater value. Preferably, the auto-rocking rocker is configured such that the auto-rocking mechanism is deactivated, disengaged, or uncoupled from the rocker when the rocker is converted from a baby sleeper configuration to a toddler seat configuration. This prevents the auto-rocking mechanism from being accidentally activated when an older and heavier child (e.g., toddler) is seated in the rocker, which may damage the auto-rocking mechanism and/or the rocker itself.

According to one aspect of the present invention, a rocker that converts from a sleeper configuration to a seat configuration is provided. The convertible rocker comprises a support section that has a concave portion for receiving a child, a frame assembly coupled to the support section, and an auto-rocking mechanism. The frame assembly includes a pair of parallel side frames, each having a front leg portion that telescopes into a connection assembly. Each side frame also has a curved bottom portion connected to the connection assembly that allows for a rocking action to the convertible rocker. A rear leg portion further extends from the curved bottom portion. The support section is pivotably connected to the front and rear leg portions.

The convertible rocker is in the sleeper configuration when the front leg portions are extended from the connection assembly and in the seat configuration when the front leg portions are retracted into the connection assembly. An auto-rocking mechanism is removably coupled to the connection assembly while the convertible rocker is in the sleeper configuration and removed from the connection assembly while the convertible rocker is in the seat configuration. Furthermore, while the convertible rocker is in the sleeper configuration, the auto-rocking mechanism provides a rocking action to the convertible rocker and prevents the convertible rocker from being converted to the seat configuration.

In one or more embodiments, the connection assembly comprises one or more leg adjustment buttons that allow the front leg portions to extend from or retract into the connection assembly. The auto-rocking mechanism prevents access to at least one of the leg adjustment buttons while the auto-rocking mechanism is coupled to the connection assembly. The connection assembly further includes a release that allows the auto-rocking mechanism to be uncoupled from the connection assembly and provide access to the at least one of the leg adjustment buttons.

In further embodiments, the support section releasably engages with the connection assembly and blocks the auto-rocking mechanism from coupling with the connection assembly while the convertible rocker is in the seat configuration. In one instance, operating a leg adjustment button simultaneously allows the support section to be released from the connection assembly and the front leg portions to be extended from the connection assembly.

According to another aspect of the present invention, a rocker is provided. The rocker includes a support section that has an outer perimeter and a concave portion for receiving a child. A frame assembly is coupled to the support section. The frame assembly allows the rocker to convert between a sleeper configuration where the outer perimeter of the support section is positioned substantially horizontal to a surface supporting the rocker and a seat configuration where the outer perimeter of the support section is positioned at an angle to the surface. The rocker further includes a removable auto-rocking mechanism. The removable auto-rocking mechanism is coupled to the frame assembly while the rocker is in the sleeper configuration and removed from the frame assembly while the rocker is in the seat configuration. In one or more embodiments, the auto-rocking mechanism must be removed from the frame assembly before the rocker can be converted from the sleeper configuration to the seat configuration.

According to yet another aspect of the present invention, a rocker convertible from a sleeper configuration to a seat configuration is provided. The rocker includes a support section that has a concave portion for receiving a child. A frame assembly is coupled to the support section and includes a connection assembly. The frame assembly includes a pair of parallel side frames, each having a front leg portion that telescopes into the connection assembly. Each side frame also has a curved bottom portion connected to the connection assembly that allows for a rocking action to the rocker. The frame assembly further includes a rear leg portion that extends from the curved bottom portion.

The rocker also includes an auto-rocking mechanism permanently coupled to the frame assembly. The auto-rocking mechanism is configured to be operable while the rocker is in the sleeper configuration and inoperable while the rocker is in the seat configuration. The front leg portions and curved bottom portions form a first angle while the rocker is in the sleeper configuration. The front leg portions and curved bottoms portion form a second angle while the rocker is in the seat configuration, wherein the second angle is smaller than the first angle. In one or more embodiments, the connection assembly comprises a leg adjustment button that allows the front leg portions to extend from or retract into the connection assembly. Retracting the front leg portions into the connection assembly causes the auto-rocking mechanism to be deactivated and become inoperable.

Other objects, features and advantages of the present invention will become apparent to those skilled in the art from the following detailed description. It is to be understood, however, that the detailed description and specific examples, while indicating some embodiments of the invention, are given by way of illustration and not limitation. Many changes and modifications within the scope of the invention may be made without departing from the spirit thereof, and the present invention includes all such modifications.

BRIEF DESCRIPTION OF THE DRAWINGS

Referring now to the drawings in which like reference numbers represent corresponding parts throughout.

DETAILED DESCRIPTION OF THE INVENTION

A rocker according to the present invention converts from a rocking infant sleeper to a rocking toddler seat. In a general embodiment, the convertible rocker comprises a support section, a frame assembly coupled to the support section, and an auto-rocking mechanism coupled to the frame assembly. The auto-rocking mechanism is operable while the convertible rocker is in the sleeper configuration and inoperable while the convertible rocker is in the seat configuration. This ensures that the auto-rocking feature is not accidentally activated while the rocker is in the seat configuration, where the heavier weight of a toddler or older child sitting in the rocker may damage the rocker and/or auto-rocking mechanism.

In one or more embodiments, the auto-rocking mechanism is removably coupled to the frame assembly while the convertible rocker is in the sleeper configuration and removed from the frame assembly while the convertible rocker is in the seat configuration. In other embodiments, the auto-rocking mechanism is permanently coupled to the frame assembly. The auto-rocking mechanism is configured to be operable only when the rocker is in the sleeper configuration. Converting the rocker to the seat configuration causes the auto-rocking mechanism to become inoperable.

Figure 1A:
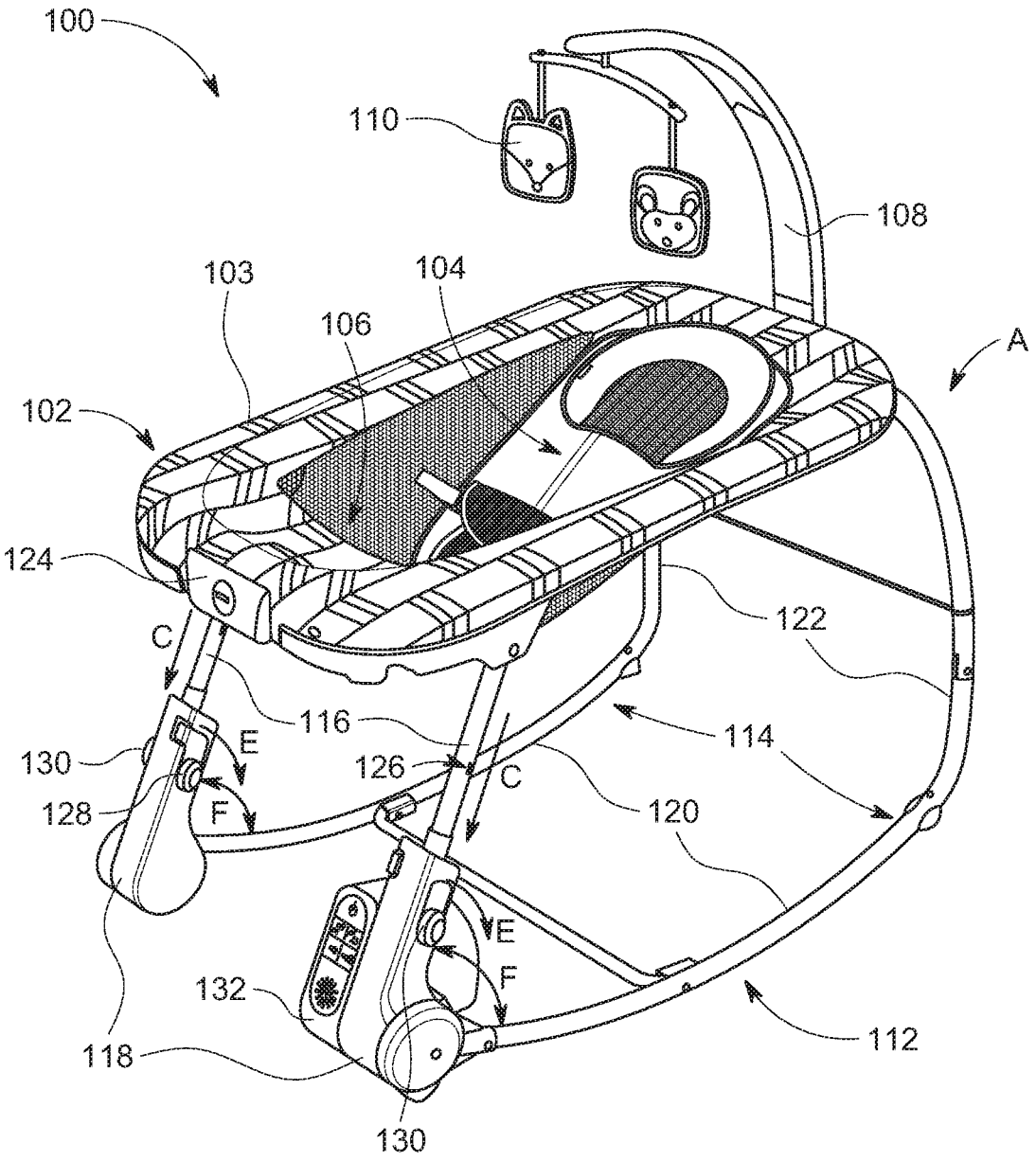
FIGS. 1A-B illustrate front perspective views of a rocker in a sleeper configuration (FIG. 1A) and a seat configuration (FIG. 1B), in accordance with one embodiment of the invention.
Figure 1B:
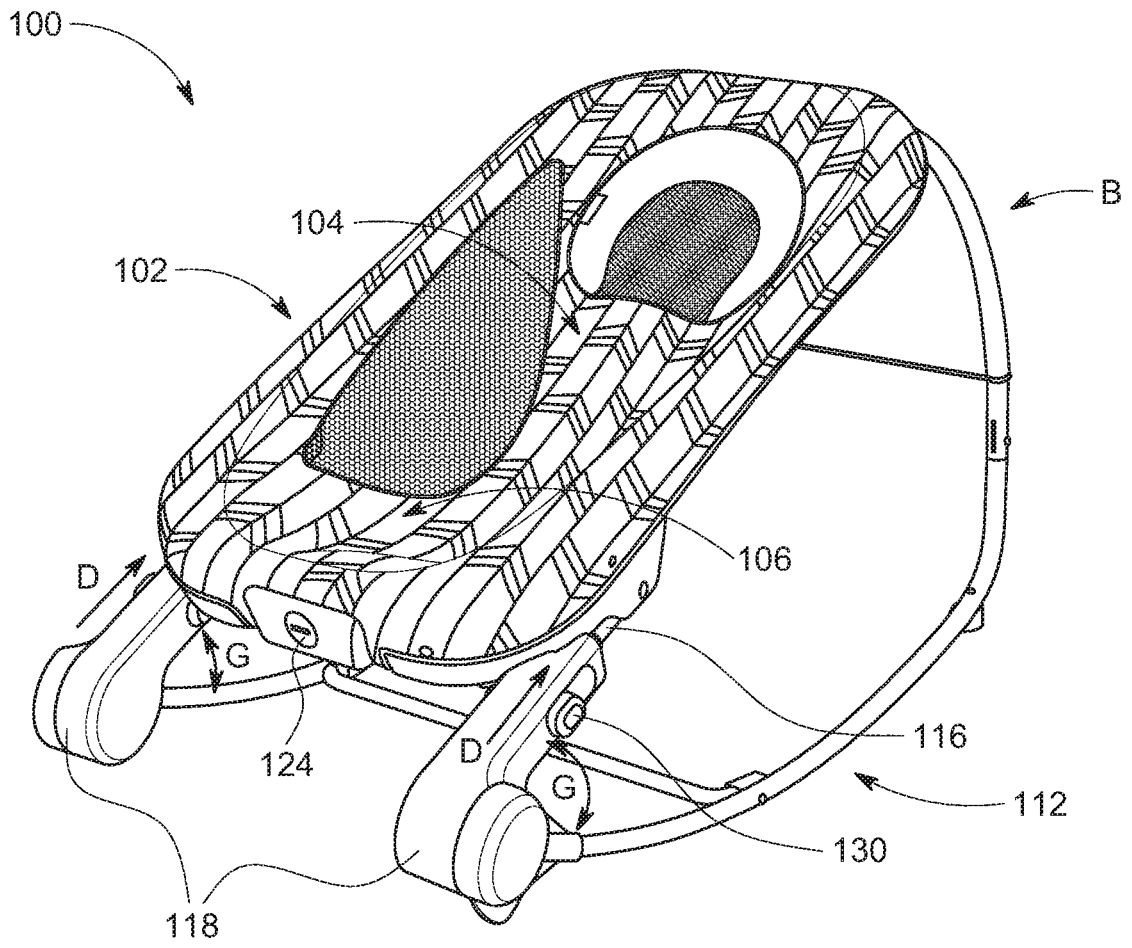

Referring now to FIGS. 1A-B, a rocker in accordance with an illustrative embodiment of the invention is shown. Rocker 100 has a support section 102 that receives and supports a young child such as an infant or toddler. The support section 102 has an outer perimeter 103 and is further contoured with a concave portion to hold an infant when the rocker is in the sleeper configuration A (see FIG. 1A) and to provide a seat for a toddler when the rocker is in the seat configuration B (see FIG. 1B). Typically, the support section 102 is substantially elliptical or oval in plan view and includes an upper support surface 104 upon which the back of a child can be positioned against and a lower support portion 106 adjacent the upper support surface 104. In the sleeper configuration A, an infant's legs and feet rest against the lower support portion 106. In the seat configuration B, a toddler's buttocks are supported by the lower support portion 106.

The upper support portion 104 and the lower support portion 106 may be integrally formed or removably coupled. In one or more embodiments, the support section 102 is manufactured from fabric or a similar material (see, e.g., FIG. 1A). In other embodiments, the support section 102 is manufactured from materials such as vinyl, molded plastic or the like (see, e.g., FIG. 2A). In some instances, the support section 102 includes a padded or quilted surface to provide greater comfort for a child positioned therein. The padded or quilted surface may be manufactured using multiple layers of fabric between which batting or other filling material is accommodated. In other instances, the support section 102 includes mesh material to provide greater airflow/breathability as well as enhanced flexibility to the support section 102 (see, e.g., FIG. 1A). In yet other embodiments, the support section includes a rigid backing to provide additional support. The rigid backing may be integral to or detached from the support section 102.

In one or more embodiments, the rocker 100 includes a removable toy bar 108 or baby mobile that suspends one or more toys or accessories 110 above the support section 102. The toy bar 108 may be removed when the rocker 100 is used as a rocking toddler seat (i.e., seat configuration B). In other embodiments, a child restraint device such as a belt is coupled to the support section 102 to secure a child in the support section 102. In certain instances, the child restraint device is removable from the support section 102 when the rocker 100 is in the seat configuration B.

As shown in FIG. 1A, the support section 102 is supported by a frame assembly 112. The frame assembly 112 includes a pair of parallel side frames 114. The side frames 114 each have a front leg portion 116 that extends and retracts from a connection assembly 118. A curved bottom portion 120 is connected to the connection assembly 118 and a rear leg portion 122 extends upwardly from the curved bottom portion 120. The frame assembly 112 is typically formed from metal tubing, though in some embodiments the frame assembly 112 is formed from plastic or similar materials with sufficient strength to support the weight of a child.

To be utilized as a rocker, the bottom portions 120 of the side frames 114 have a curvature that allows for smooth rocking motions. The extent of the curvature of the bottom portions 120 determines the particular rocking motion imparted to the rocker 100. In one or more embodiments, the side frames include front stops and rear stops (see, e.g., FIG. 2B). In the second embodiment of the rocker 200 illustrated in FIG. 2B, the front stops 242 and rear stops 244 are configured to prevent the rocker 200 from traveling too far and tipping over when rocking.

Figure 2A:
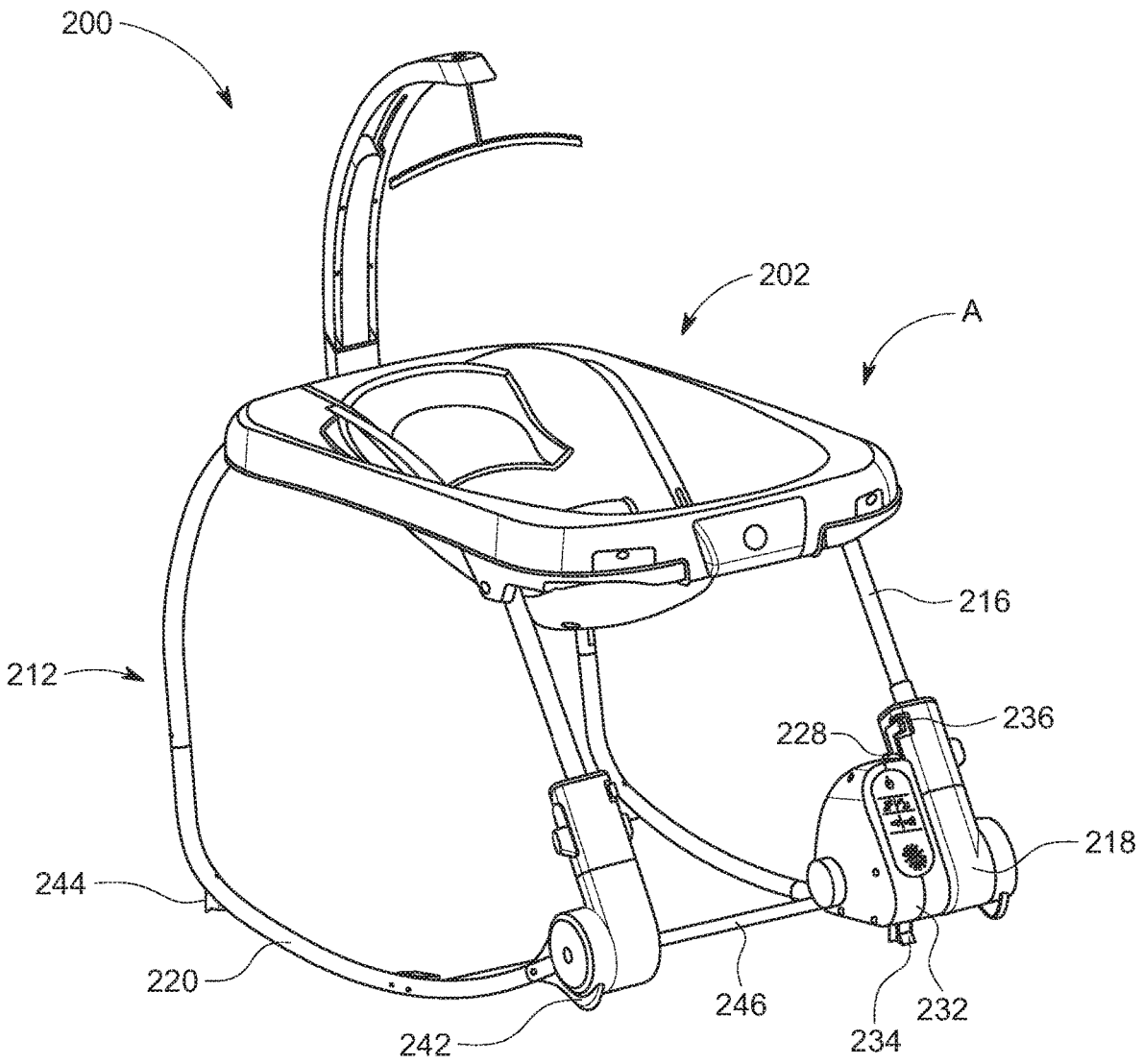
FIGS. 2A-B illustrate a front perspective view (FIG. 2A) and a bottom perspective view (FIG. 2B) of a rocker, in accordance with another embodiment of the invention.
Figure 2B:
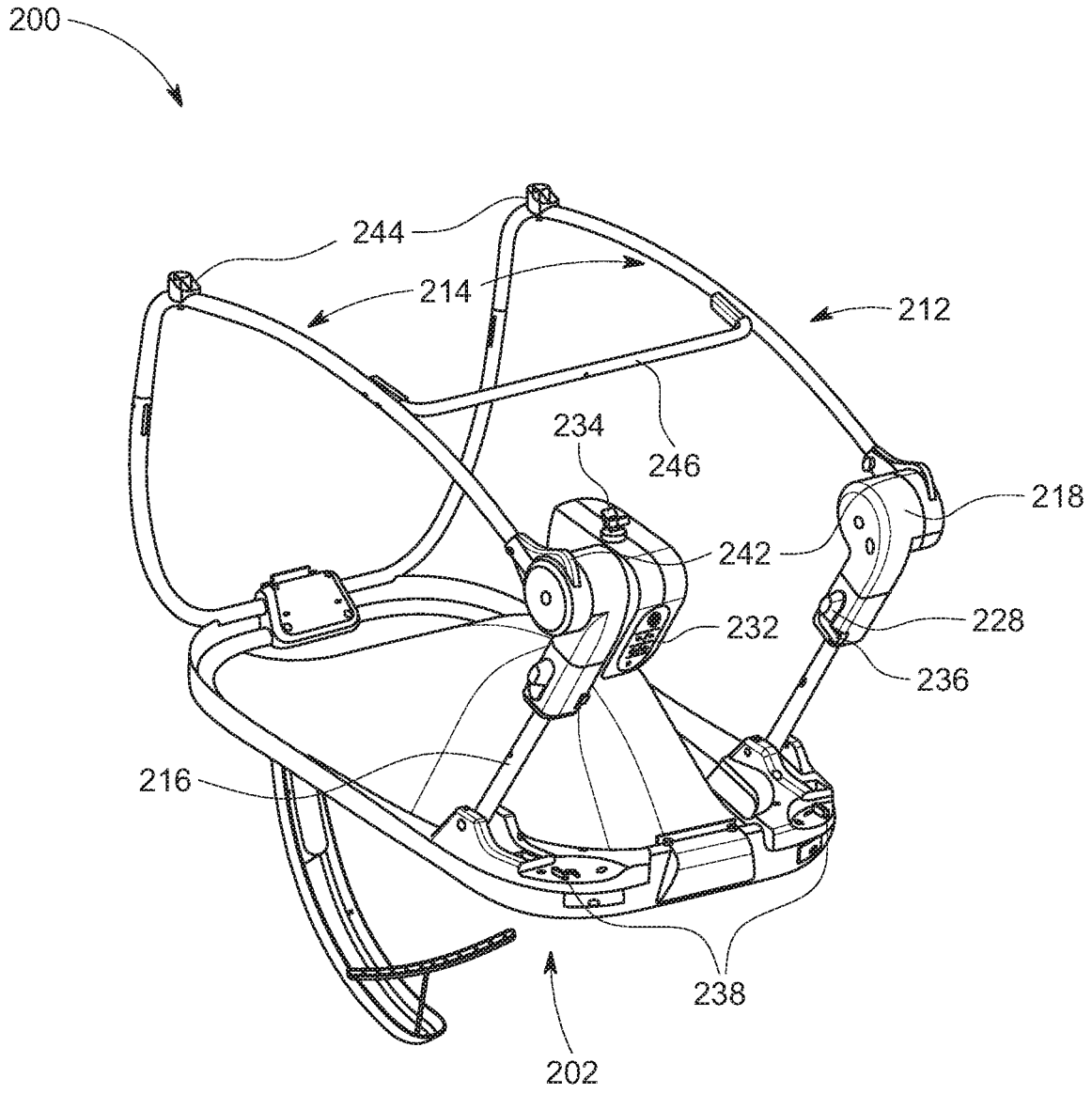

FIG. 2B also shows the frame assembly 212 of the second embodiment of the rocker 200, the frame assembly 212 including a cross bar 246 connected to the side frames 214. The cross bar 246 provides additional structural rigidity to the frame assembly 212. In other embodiments, the cross bar is a kickstand that can be positioned to prevent the rocker from rocking. In this configuration, the rocker is retained in a stationary position supported by the kickstand and the rear stops.

Referring back to FIG. 1A, the rocker 100 is shown in a sleeper configuration A where the front leg portions 116 are extended from the connection assembly 118. This positions the outer perimeter 103 of the support section 102 substantially horizontal to a surface supporting the rocker 100 and allows the rocker 100 to function as an infant sleeper. In this configuration, the front leg portions and curved bottom portions form a first angle F.

By retracting the front leg portions 116 into the connection assembly 118 in the direction of arrows C, the rocker 100 converts from the sleeper configuration A (see FIG. 1A) to a seat configuration B (see FIG. 1B). This may be achieved, for example, by pushing a front edge 124 of the support section 102 downwards (i.e., towards the support surface/floor). As shown in FIG. 1B, the retracted front leg portions 116 in the seat configuration B position the outer perimeter 103 of the support section 102 at an angle to the surface, which allows the rocker 100 to function as a toddler seat. In this configuration, the front leg portions and curved bottoms portion form a second angle G that is smaller than the first angle F shown in FIG. 1A.

Furthermore, the support section 102 is movably connected to the frame assembly 112. In one or more embodiments, both the front leg portions 116 and rear leg portions 122 are pivotably connected to the support section 102 (see, e.g., FIG. 1A). This allows the support section 102 of the rocker 100 to shift its angle with respect to the supporting surface (i.e., convert between the sleeper configuration and seat configuration). Additionally, as the front leg portions 116 retract, the connections assembly 118 pivots in the direction of arrows E to further facilitate the angling of the support section 102.

The rocker 100 converts from the seat configuration B back to the sleeper configuration A by extending/telescoping the front leg portions 116 from the connection assembly 118 in the direction of arrows D (see FIG. 1B). This may be achieved, for example, by pulling the front edge 124 of the support section 102 upwards (i.e., away from the support surface/floor).

In one or more embodiments, the front leg portions 116 include multiple detents or holes 126 that engage with the connection assembly 118 to maintain the rocker 100 in the sleeper or seat configurations (see, e.g., FIG. 1A). The connection assembly 118 also has at least one leg adjustment button that can be pressed so that the connection assembly 118 disengages with the detent or hole 126 on the front leg portion 116.

In the illustrative embodiment shown in FIG. 1A, the connection assembly 118 includes an inner leg adjustment button 128 and an outer leg adjustment button 130 that need to be pinched together before the respective front leg portion 116 can be repositioned. Protrusions inside the connection assembly 118 are spring-biased to a default position that engages with the holes 126 on the front leg portion 116. Pinching the leg adjustment buttons 128, 130 causes the protrusions to retract and disengage from the holes, which subsequently allows a user to extend or retract the front leg portion 116 from the connection assembly 118. In some embodiments, the front leg portion 116 includes multiple detents or holes 126 vertically displaced along the front leg portion 116 so that the support section 102 can be adjusted to be at various angles to the floor.

In other embodiments, the front leg portions 116 are moved mechanically rather than manually by a user. Actuators and motors within the connection assembly 118 mechanically extend or retract the front leg portions 116 when a user presses a corresponding leg adjustment button. For example, the leg adjustment buttons may cause the rocker to transform to the sleeper configuration, transform to the seat configuration, continuously or incrementally move the support section upwards, and/or continuously or incrementally move the support section downwards.

Continuing with reference to FIG. 1A, an auto-rocking mechanism 132 is coupled to a section of the connection assembly 118 while the rocker 100 is in a sleeper configuration A. The auto-rocking mechanism 132 is configured to mechanically rock the rocker 100 when the rocker 100 is in the sleeper configuration A. Turning now to FIG. 2A, another auto-rocking mechanism 232 is coupled to a connection assembly 218 while the rocker 200 is in a sleeper configuration A. The auto-rocking mechanism 132 illustrated in FIG. 1A may be substantially similar to the auto-rocking mechanism 232 illustrated in FIG. 2A. The auto-rocking mechanism 232 is also configured to mechanically rock the rocker 200. In an exemplary implementation, the auto-rocking mechanism 232 has an actuator 234 that reciprocates between an extended position and a retracted position. In the extended position, the actuator 234 pushes against a supporting surface or floor, which causes the rocker 200 to tip backwards (i.e., towards the rear stops 244). When the actuator 234 moves to the retracted position, the rocker 200 tips forward (i.e., towards the front stops 242) due to the gravitational force pulling on the rocker 200. The reciprocating motion of the actuator 234 results in the rocker 200 smoothly rocking back and forth along the curved bottom portions 220 of the rocker 200.

Figure 3:
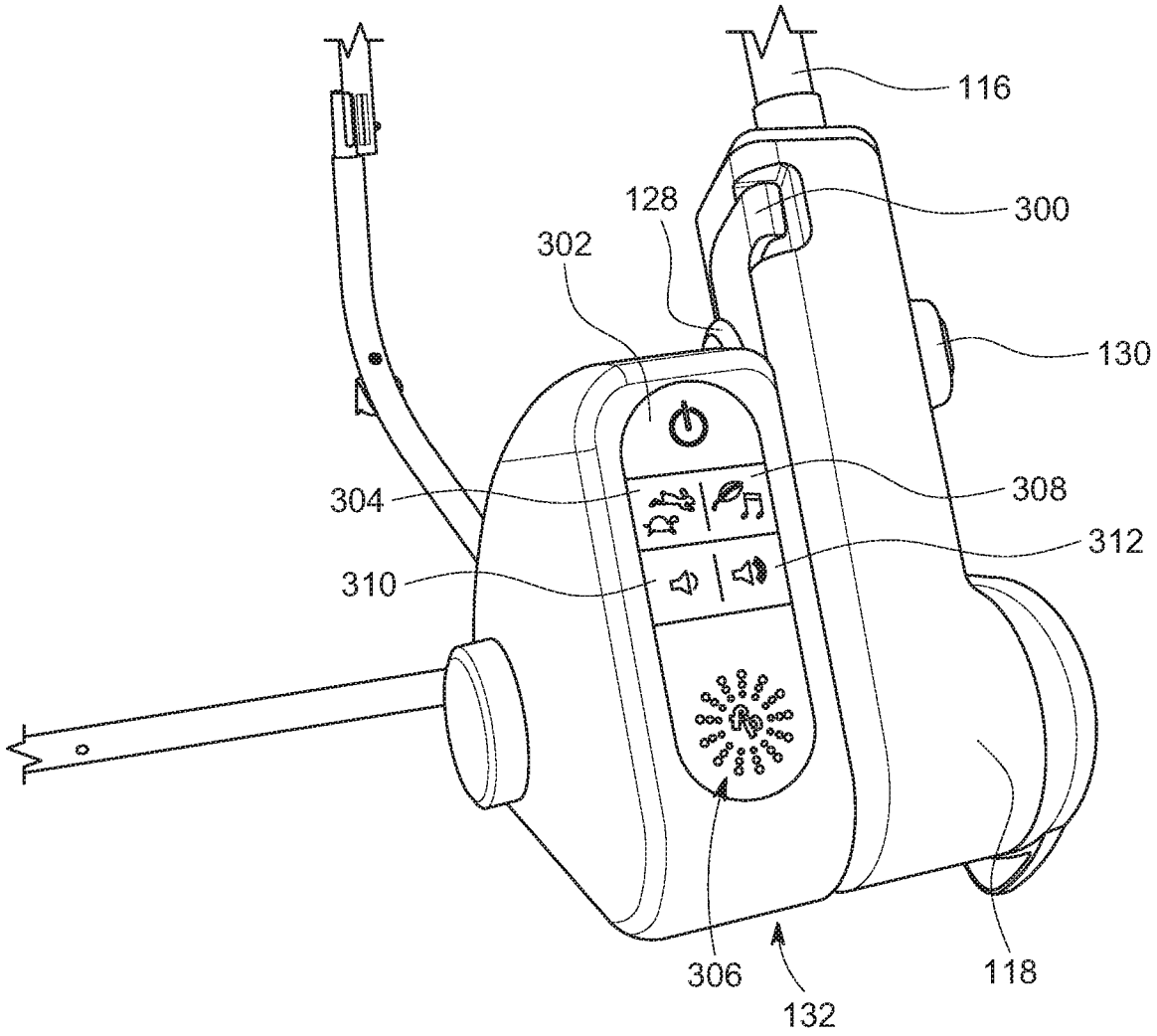
FIG. 3 illustrates a close-up perspective view of an auto-rocking mechanism of the rocker of FIGS. 1A-B.

The auto-rocking mechanism may include various controls and/or additional functions. FIG. 3 provides a closer view of an illustrative embodiment of an auto-rocking mechanism 132. The auto-rocking mechanism 132 has a power button 302 and a rocking speed selector button 304. The auto-rocking mechanism 132 is also configured to emit sounds such as music, nature sounds, or soothing sounds from a speaker 306. The different sounds can be selected by pressing the sound selector button 308. Volume control buttons 310, 312 allow the volume of the emitted sounds to be decreased or increased, respectively.

In one or more embodiments, the auto-rocking mechanism is further configured to generate vibrations. The vibrations generated by the auto-rocking mechanism are imparted to the frame assembly and the support section to soothe an infant in the rocker. Different vibration strengths and/or vibration patterns may be adjusted or selected. In other embodiments, the auto-rocking mechanism includes a timer. The rocker may be set to rock for a desired amount of time and then automatically stop rocking after the set time has elapsed. Preferably, the auto-rocking mechanism is powered by a rechargeable or disposable battery. In other embodiments, the auto-rocking mechanism is powered by connecting a plug and cable to an electrical outlet.

Referring back to FIGS. 1A-B, as previously explained, the auto-rocking mechanism 132 is coupled to the connection assembly 118 while the rocker 100 is in the sleeper configuration A (see FIG. 1A). Further, the auto-rocking mechanism 132 is removed from the connection assembly 118 while the rocker 100 is in the seat configuration B (see FIG. 1B). Whereas the sleeper configuration A of the rocker 100 is designed to receive an infant, the seat configuration B of the rocker 100 is designed to receive an older child, such as a toddler. In comparison to an infant, a toddler may be too heavy for the auto-rocking mechanism 132 to function properly. In certain instances, the actuator of the auto-rocking mechanism 132 is unable to generate sufficient force to rock the rocker 100 while a toddler is sitting in the rocker 100. Operating the auto-rocking mechanism 132 under such conditions may break or damage the actuator or motor coupled to the actuator. Therefore, the rocker 100 is configured so that the auto-rocking mechanism 132 must be removed from the connection assembly 118 or frame assembly 112 before the rocker can be converted from the sleeper configuration A to the seat configuration B. This prevents the auto-rocking mechanism 132 from being accidentally activated when an older and heavier child (e.g., toddler) is seated in the rocker 100, which may damage the actuator, auto-rocking mechanism 132, and/or rocker 100 itself.

In one or more embodiments, removal of the auto-rocking mechanism 132 prior to converting the rocker 100 configuration is ensured by positioning the auto-rocking mechanism 132 such that it obstructs or impedes access to at least one of the leg adjustment buttons 128. As a result, the auto-rocking mechanism 132 must be removed in order to access the leg adjustment button 128 and convert the rocker 100 from the sleeper configuration A to the seat configuration B. As shown in FIG. 3, the auto-rocking mechanism 132 is coupled to the connection assembly 118 and physically obstructs or prevents a user from accessing the inner leg adjustment button 128. The auto-rocking mechanism 132 must first be removed before the leg adjustment buttons 128, 130 can be pinched together to disengage front leg portion 116 and allow it to retract into the connection assembly 118.

Figure 4:
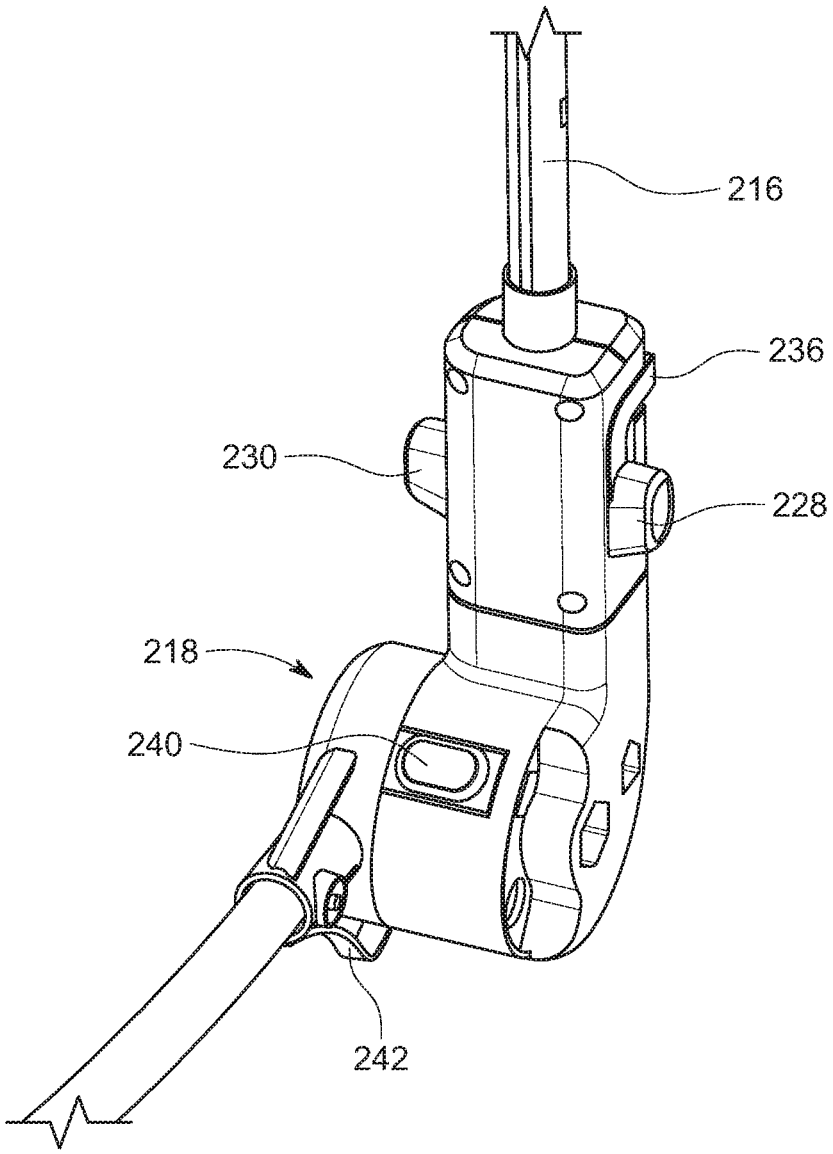
FIG. 4 illustrates a close-up back perspective view of the rocker of FIGS. 2A-B with the auto-rocking mechanism removed.

In one or more embodiments, the auto-rocking mechanism 132 is coupled to the connection assembly 118 using interlocking latches. The auto-rocking mechanism 132 may also be coupled to the connection assembly 118 using other methods such as magnets. As shown in FIG. 4, the second embodiment of the connection assembly 218 further includes a release 240 for uncoupling the auto-rocking mechanism 232 from the connection assembly 218.

Additionally, one or more embodiments of the rocker are configured such that a removed auto-rocking mechanism cannot be coupled to the rocker while the rocker is in the seat configuration. For example, as shown in FIG. 1B, the support section 102 blocks an auto-rocking mechanism from coupling with the connection assembly 118 while the rocker 100 is in the seat configuration B.

In some embodiments, the support section releasably engages with the connection assembly to help maintain the rocker in the seat configuration. In FIG. 2B, the connection assembly 218 includes a latch 236 that engages with a latch engagement 238 underneath the support section 202. In one or more embodiments, operating the inner leg adjustment button 228 simultaneously releases the support section 202 from the connection assembly 218 (e.g., disengages the latch 236 from the latch engagement 238) and disengages the front leg portion 216 from the connection assembly 218.

In other embodiments, the rocker is configured such that the auto-rocking mechanism does not need to be physically removed from the rocker. In such instances, the auto-rocking mechanism deactivates the auto-rocking feature while the rocker is in the seat configuration. This is accomplished, for example by using mechanical/electrical switches or sensors that are triggered when the front leg is retracted into the connection assembly. The auto-rocking feature is re-activated when the rocker is converted back into the sleeper configuration and the front leg is extended from the connection assembly.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims.

Moreover, it is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" may be used herein to describe an example or illustration. Any embodiment described herein as exemplary is not to be construed as a preferred or advantageous embodiment, but rather as one example or illustration of a possible embodiment of the invention.

Finally, various features from one of the embodiments may be incorporated into another of the embodiments. Accordingly, it is appropriate that the appended claims be construed broadly and in a manner consistent with the scope of the disclosure as set forth in the following claims.

The invention claimed is:

1. A rocker convertible from a sleeper configuration to a seat configuration, the convertible rocker comprising:

a support section, the support section having a concave portion for receiving a child;

a frame assembly coupled to the support section, the frame assembly including at least one connection assembly, a pair of parallel side frames each having a front leg portion that telescopes into the connection assembly, a curved bottom portion connected to the connection assembly that allows for a rocking action to the convertible rocker, and a rear leg portion extending from the curved bottom portion; and an auto-rocking mechanism removably coupled to the connection assembly while the convertible rocker is in the sleeper configuration and removed from the connection assembly while the convertible rocker is in the seat configuration, the auto-rocking mechanism providing a rocking action to the convertible rocker and preventing the convertible rocker from converting to the seat configuration while the convertible rocker is in the sleeper configuration;

wherein the convertible rocker is in the sleeper configuration when the front leg portions are extended from the connection assembly and in the seat configuration when the front leg portions are retracted into the connection assembly.

2. The convertible rocker of claim 1, wherein the connection assembly comprises one or more leg adjustment buttons that allow the front leg portions to extend from or retract into the connection assembly.

3. The convertible rocker of claim 2, wherein the auto-rocking mechanism prevents access to at least one of the leg adjustment buttons while the auto-rocking mechanism is coupled to the connection assembly.

4. The convertible rocker of claim 2, wherein the support section releasably engages with the connection assembly and blocks the auto-rocking mechanism from coupling with the connection assembly while the convertible rocker is in the seat configuration.

5. The convertible rocker of claim 4, wherein operating at least one of the leg adjustment buttons simultaneously allows the support section to be released from the connection assembly and the front leg portions to extend from the connection assembly.

6. The convertible rocker of claim 1, wherein the connection assembly includes a release that allows the auto-rocking mechanism to be uncoupled from the connection assembly.

7. The convertible rocker of claim 1, wherein the support section is pivotably connected to both the front and rear leg portions.

8. A rocker comprising:

a support section, the support section having an outer perimeter and a concave portion for receiving a child;

a frame assembly coupled to the support section, the frame assembly allowing the rocker to convert between a sleeper configuration where the outer perimeter of the support section is positioned substantially horizontal to a surface supporting the rocker and a seat configuration where the outer perimeter of the support section is positioned at an angle to the surface, the frame assembly includes at least one connection assembly, and a pair of parallel side frames each having a front leg portion that telescopes into the connection assembly and a curved bottom portion connected to the connection assembly that allows for a rocking action to the rocker; and a removable auto-rocking mechanism, the removable auto-rocking mechanism coupled to the frame assembly while the rocker is in the sleeper configuration and removed from the frame assembly while the rocker is in the seat configuration.

9. The rocker of claim 8, wherein the auto-rocking mechanism must be removed from the frame assembly before the rocker can be converted from the sleeper configuration to the seat configuration.

10. The rocker of claim 8, wherein the auto-rocking mechanism couples to the connection assembly of the frame assembly.

11. The rocker of claim 10, wherein the connection assembly includes a release that allows the auto-rocking mechanism to be uncoupled from the connection assembly.

12. The rocker of claim 8, wherein the rocker is in the sleeper configuration when the front leg portions are extended from the connection assembly and in the seat configuration when the front leg portions are retracted into the connection assembly.

13. The rocker of claim 8, wherein the connection assembly comprises one or more leg adjustment buttons that allow the front leg portions to extend from or retract into the connection assembly.

14. The rocker of claim 13, wherein the auto-rocking mechanism prevents access to at least one of the leg adjustment buttons while the auto-rocking mechanism is coupled to the frame assembly.

15. The rocker of claim 14, wherein the support section releasably engages with the frame assembly while the rocker is in the seat configuration.

16. The rocker of claim 15, wherein operating at least one of the leg adjustment buttons simultaneously allows the support section to be released from the frame assembly and the front leg portions to extend from the connection assembly.

17. A rocker convertible from a sleeper configuration to a seat configuration, the rocker comprising:

a support section, the support section having a concave portion for receiving a child;

a frame assembly coupled to the support section, the frame assembly including a connection assembly, a pair of parallel side frames each having a front leg portion that telescopes into the connection assembly, a curved bottom portion connected to the connection assembly that allows for a rocking action to the rocker, and a rear leg portion extending from the curved bottom portion; and an auto-rocking mechanism coupled to the frame assembly, the auto-rocking mechanism configured to be operable while the rocker is in the sleeper configuration and inoperable while the rocker is in the seat configuration;

the front leg portions and curved bottom portions forming a first angle while the rocker is in the sleeper configuration, and the front leg portions and curved bottoms portion forming a second angle while the rocker is in the seat configuration, wherein the second angle is smaller than the first angle.

18. The rocker of claim 17, wherein the connection assembly comprises a leg adjustment button that allows the front leg portions to extend from or retract into the connection assembly, and further wherein retracting the front leg portions into the connection assembly causes the auto-rocking mechanism to be deactivated and become inoperable.

19. The rocker of claim 18, wherein the support section releasably engages with the connection assembly while the front leg portions are retracted into the connection assembly, and further wherein operating the leg adjustment button simultaneously allows the support section to be released from the connection assembly and the front leg portions to extend from the connection assembly.

20. The rocker of claim 8, wherein the frame assembly is pivotably connected to the support section.

* * * * *